US006112432A

United States Patent [19]

Bray, Jr. et al.

[11] Patent Number: 6,112,432

[45] Date of Patent: Sep. 5, 2000

[54] INSOLE, FOOTWEAR, AND METHOD FOR MANUFACTURING FOOTWEAR

[75] Inventors: Walter Thomas Bray, Jr., Reynoldsburg; Beverly Poindexter; Florence Melton, both of Columbus, all of Ohio

[73] Assignee: R. G. Barry Corporation, Pickerington, Ohio

[21] Appl. No.: 09/241,207

[22] Filed: Feb. 1, 1999

[51] Int. Cl.[7] ..... A43B 13/38; A43B 1/02

[52] U.S. Cl. ..... 36/44; 36/9 R; 36/29

[58] Field of Search ..... 36/3 R, 3 B, 9 R, 36/29, 71, 11.5, 43, 44

[56] References Cited

U.S. PATENT DOCUMENTS

| | | | |
|---|---|---|---|
| D. 347,518 | 6/1994 | Stewart . | |
| 1,916,067 | 6/1933 | Naidor | 36/9 R |
| 2,739,093 | 3/1956 | Bull | 36/44 |
| 2,845,723 | 8/1958 | Arnold | 36/9 R |
| 2,911,973 | 11/1959 | Chieffo | 36/3 B |
| 2,917,850 | 12/1959 | Scholl | 36/44 |
| 3,221,422 | 12/1965 | Lemeshnik | 36/9 R |
| 3,555,709 | 1/1971 | Raffaelli | 36/3 B |
| 3,785,069 | 1/1974 | Brown | 36/3 B |
| 4,054,706 | 10/1977 | Shapiro | 36/44 |
| 4,170,078 | 10/1979 | Moss | 36/3 B |
| 5,012,541 | 5/1991 | Ganon | 36/9 R |
| 5,392,532 | 2/1995 | Bray, Jr. et al. . | |
| 5,491,860 | 2/1996 | Bray et al. . | |
| 5,644,856 | 7/1997 | Bray, Jr. . | |

*Primary Examiner*—M. D. Patterson
*Attorney, Agent, or Firm*—Merchant & Gould P.C.

[57] ABSTRACT

An insole for use in a slipper is provided. The insole includes a first cushion layer and a second cushion layer. The first cushion layer includes a first foam layer and an air permeable membrane covering the first foam layer. The second cushion layer includes a second foam layer and an air permeable membrane covering the second foam layer. The first cushion layers are arranged so that the air permeable membrane of each layer faces outward, and the first cushion layer and the second cushion layer are attached together along their perimeter to provide a cavity between the first cushion layer and the second cushion layer. The insole can be referred to as pillow cushion because of the formation of a cavity between the first cushion layer and the second cushion layer. A slipper and a method for manufacturing a slipper are provided.

16 Claims, 4 Drawing Sheets

INSOLE, FOOTWEAR, AND METHOD FOR MANUFACTURING FOOTWEAR

FIELD OF THE INVENTION

This invention relates to an insole, footwear, and method of manufacturing footwear. In particular, the insole can be used in a slipper and provides a cavity into which air can enter and escape at a controlled rate to provide cushioning.

BACKGROUND OF THE INVENTION

The footwear industry is an old and crowded art. The industry is constantly attempting to design new products with aesthetic appeal, as well as being comfortable and having ease of construction.

Various designs of slippers have been available for a number of years. In general, slippers are a type of footwear having a generally soft construction and which are generally washable in a conventional clothes washing machine. Slippers are intended to be used in a relaxing and comfortable atmosphere. They are typically not manufactured using a last, which is often a necessary device when manufacturing a shoe including a hard sole and a leather upper.

SUMMARY OF THE INVENTION

An insole for use in footwear is provided by the invention. Preferred types of footwear for which the insole can be used includes slippers. The insole includes a first cushion layer and a second cushion layer. The first cushion layer includes a first foam layer and an air permeable membrane covering the first foam layer. The second cushion layer includes a second foam layer and an air permeable membrane covering the second foam layer. The first cushion layer and the second cushion layer are arranged so that the air permeable membrane of each layer faces outward, and the first cushion layer and the second cushion layer are attached together along their perimeter to provide a cavity between the first cushion layer and the second cushion layer. The insole can be referred to as a "pillow cushion" because of its general shape which is created by the existence of a cavity between the first cushion layer and the second cushion layer.

A slipper is provided according to the invention. The slipper includes an outsole, a vamp, a liner, and an insole. The vamp can be attached to the outsole along an outsole edge, and the liner is preferably attached to the vamp. The insole is provided covering the outsole to provide a cushion for the wearer's foot. In a preferred embodiment, the insole can be attached to the liner.

A method for manufacturing a slipper is provided by the invention. The method includes steps of manufacturing the pillow cushion, and inserting the pillow cushion inside an insole area of a slipper.

DESCRIPTION OF THE PREFERRED EMBODIMENTS

Figure 1:
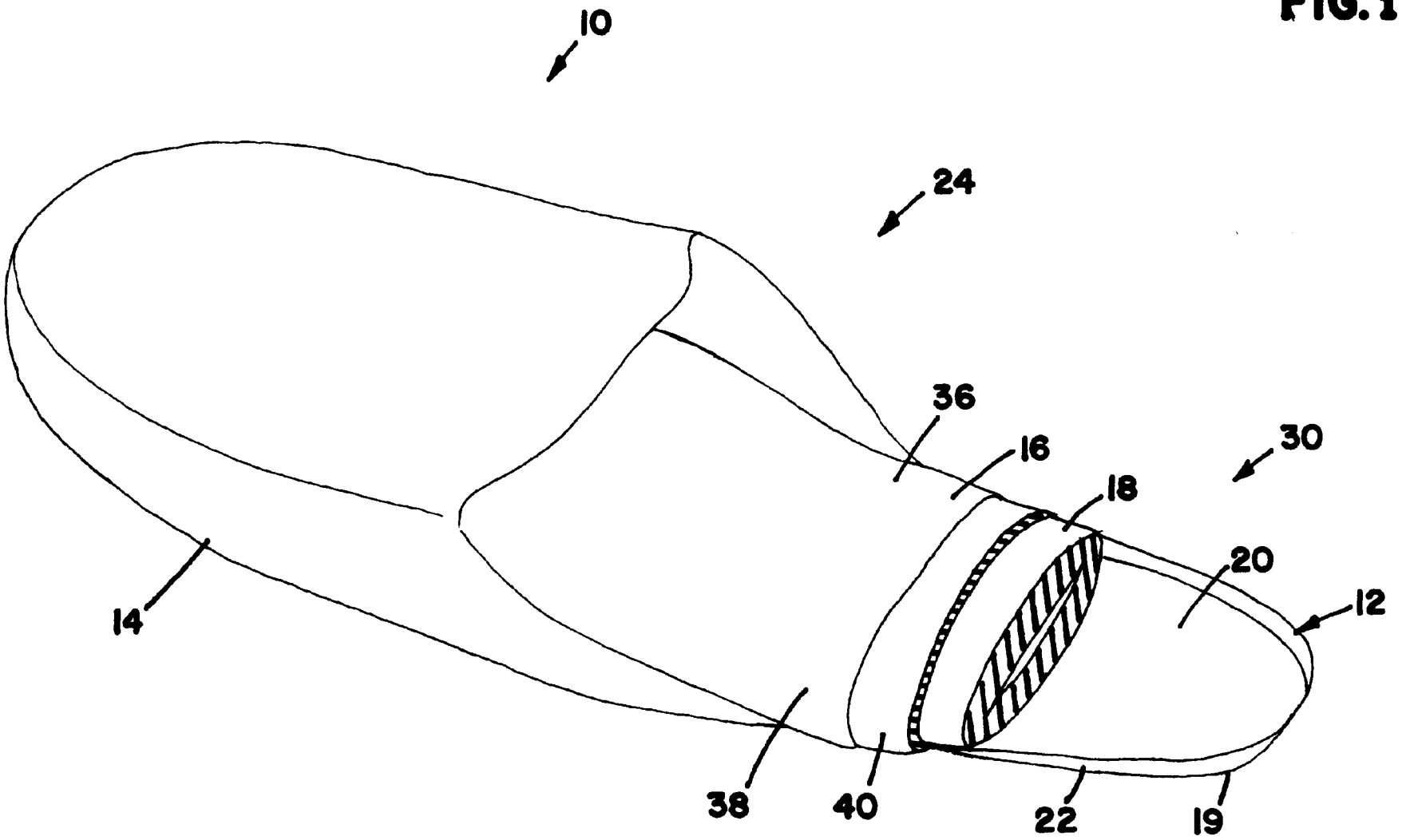
FIG. 1 is a partial cut away perspective view of a slipper according to the principles of the present invention.

Now referring to FIG. 1, a slipper according to the principles of the present invention is shown at reference numeral 10. Slipper 10 includes an outsole 12, a vamp 14, a liner 16, and an insole 18. The outsole 12 includes a bottom surface 19 which contacts the ground, a top surface 20 which supports the insole 18, and an edge 22 which extends around the perimeter of the outsole 12. The vamp 14 attaches to the outsole edge 22 and provides a foot receiving area 24 which generally wraps and encloses the wearer's foot. The liner 16 attaches to the outsole edge 22 to provide the insole receiving area 30. The insole 18 is provided within the insole receiving area 30.

The outsole 12 is generally a flexible and durable structure which resists wear. Typical materials used in the construction of slipper outsole are known and can be used. Exemplary materials include leather, vinyl, synthetic rubber, natural rubber and ethylene vinyl acetate polymer. The outsole 12 is generally provided with a shape so that its perimeter generally corresponds with the shape of the slipper.

The vamp 14 covers at least a portion of the wearer's foot and keeps the wearer's foot secure within the slipper. The vamp 14 may include decorative features and may be padded. The vamp 14 any conventional attachment technique utilized in the slipper industry including mechanical attachment such as stitching, stapling, welding, or combination thereof, and any suitable chemical attachment technique including the use of adhesives. It should be appreciated that the components of the slipper described by this application can be attached by any one or combination of these attachment techniques. The vamp 14 is preferably attached to the outsole edge 22 by stitching. In certain slipper constructions, the outsole and vamp may be molded as a unitary structure.

The vamp 14 and liner 16 should be sufficiently durable to withstand the stresses of repeated insertion of the foot into the slipper 10 and remain soft and pliable to conform to the wearer's foot. Exemplary materials which can be used to form the vamp and liner include woven materials, knitted materials, non-woven materials, and molded materials such as natural or synthetic rubber. The vamp and liner can preferably include a foam material for softness. Exemplary surface materials for the vamp and liner include terry, pile, velours, woven cottons, leather (including suede), sweater knits, and jacquard knits. A preferred surface material is a cotton terry-cloth material. While the vamp 14 is shown attached to the toe and instep regions of the slipper 10, it should be appreciated that it can be extended so that it attaches to the heel region of the slipper 10. In addition, alternative designs are available where the vamp does not attach to the toe region. Such designs can be referred to as open toe designs while an open heel design is shown in FIG. 1.

The liner 16 attaches to the outsole edge 22 to provide the insole receiving area 30. The liner 16 is preferably attached to the outsole edge 22 by stitching, but can be attached by other techniques described above including gluing. The liner 16 is preferably attached to the entire circumference of the outsole edge 22 so that the insole 18 is contained within the insole receiving area 30. For the slipper design shown in FIG. 1, it should be appreciated that the insole 18 is not stitched to either the liner 16 or the outsole 12. In an alternative embodiment of the invention, the insole can be stitched to the liner and/or the outsole. In fact, the liner can form a component of the insole as described in reference to the slipper shown in FIG. 6.

The liner 16 can be referred to as the sock and provides a barrier between the wearer's foot and the insole 18 and outsole 12. Accordingly, the liner 16 is preferably a soft material. Preferably, the liner 16 is a laminate structure 36 including a fabric material 38 and a foam material 40. Exemplary fabric materials 38 include woven and non-woven materials. It should be appreciated that the materials which can be used to form the outsole 12, vamp 14, and liner 16 are well known in the footwear industry.

Figure 3:
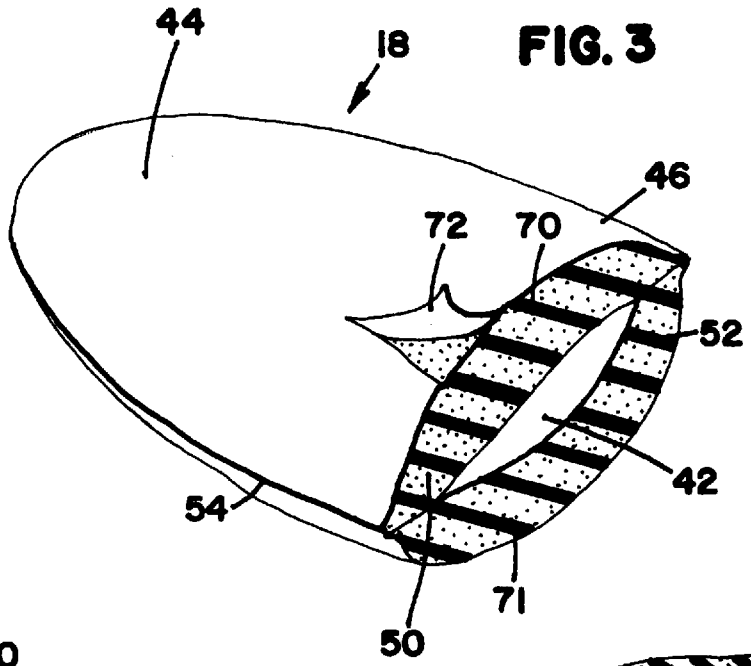
FIG. 3 is a sectional view of the slipper insole shown in FIG. 2 taken along lines 3—3.
Figure 4:
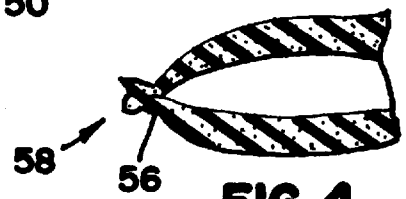
FIG. 4 is a sectional view of the slipper insole of FIG. 3.
Figure 2:
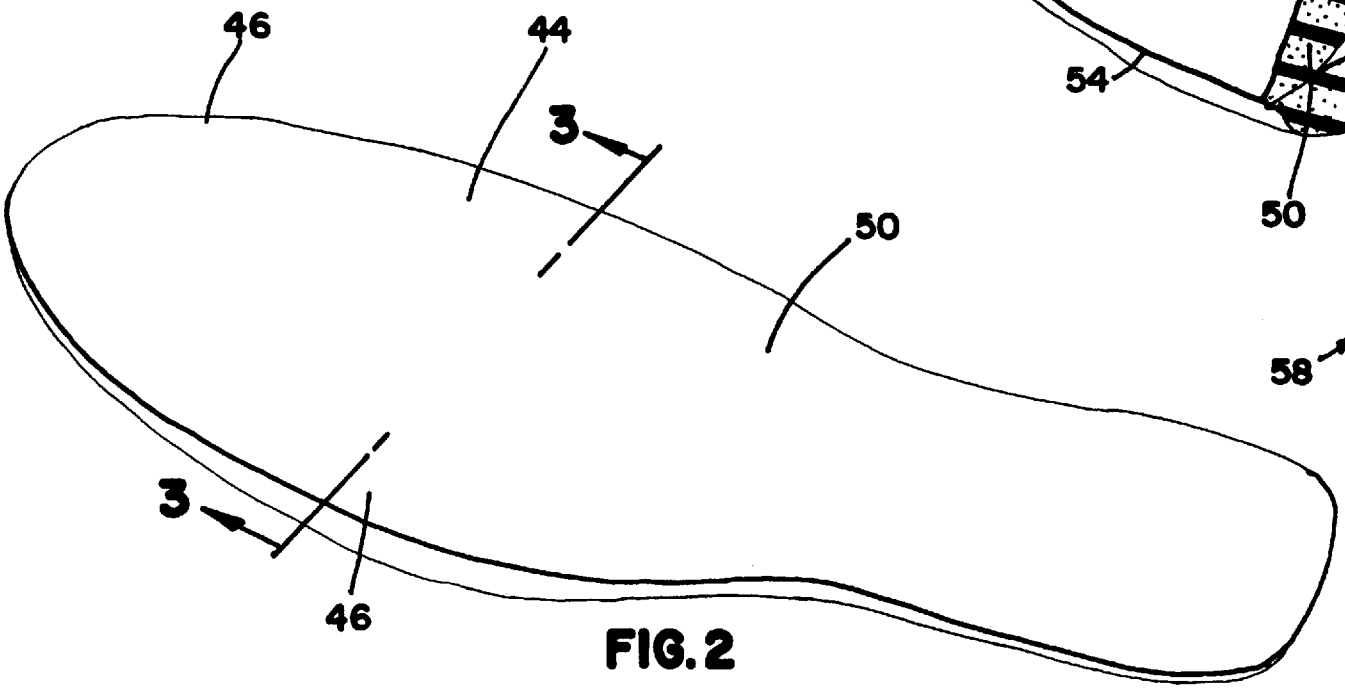
FIG. 2 is a perspective view of a slipper insole according to the principles of the present invention.

Referring now to FIGS. 2 and 3, the insole 18 is shown in more detail. The insole 18 includes a cavity 42 which allows air to enter and escape at a controlled rate to provide cushioning. The insole 18 can be referred to as a "pillow cushion" because of its general shape which provides a central cushion area 44 which then tapers to the edges 46. Typical prior art insoles used in slippers are relatively flat foam structures which do not exhibit a pillowy appearance or include a cavity which allows air to enter and escape at a controlled rate to provide cushioning.

The insole 18 includes a first cushion layer 50 and a second cushion layer 52. The first cushion layer 50 can be referred to as the top cushion layer because of its location in proximity to the liner 16. The second cushion layer 52 can be referred to as the bottom cushion layer because of its location in proximity to the outsole 12. The first cushion layer 50 and the second cushion layer 52 are secured together along their perimeters 54 to provide a seam 56. Preferably, the first cushion layer 50 and the second cushion layer 52 are sewn together along the seam 56 to provide an exterior flange 58. Of course, the first cushion layer 50 and the second cushion layer 52 can be attached by stapling, sealing (including radio frequency welding or heat sealing), and by adhesive. By securing the securing the first cushion layer 50 and the second cushion layer 52 together along their perimeters 54, a cavity 42 is provided. The cavity 42 is created by the stresses provided within the first cushion layer 50 and the second cushion layer 52 as a result of their being secured together along their perimeters 54.

The cavity 42 is filled with air, and the volume of the cavity 42 can increase or decrease as pressure is applied thereto. The insole 18 shown in FIG. 3 is shown in a relaxed or non-compressed state. In contrast, when bearing the weight of a wearer, the cavity 42 will evacuate as the first cushion layer 50 is compressed onto the second cushion layer 52. Of course, the rate of flow of air from the cavity 42 will provide a cushioning effect. In general, the volume of the cavity when the insole is provided in a relaxed state is large enough to provide a desired degree of cushioning and not so great that it provides an awkward amount of cushioning. In general, it is preferred that for an insole in a relaxed state, the cavity should have a volume which is between about 10% and about 40% of the volume of the insole. More preferably, the cavity has a volume which is between about 15% and about 30% of the volume of the insole. In a most preferred embodiment, the cavity has a volume which is about 25% of the volume of the insole. Another way of characterizing the cavity is by comparing the height of the insole of the invention with the height of the first cushion layer and the second cushion layer where they are not attached together to provide a cavity. In general, it is expected that the height of the insole of the invention will be at least 10% greater than the height of the non-attached first cushion layer and second cushion layer stacked together. Stated differently, the creation of a cavity is responsible for at least a 10% increase in height of the insole of the invention compared with the components provided on top of each other but without the attachment along the perimeter. In general, it is preferred that the creation of the cavity results in at least a 20% increase in height, and more preferably at least a 25% increase in height.

The first cushion layer 50 and the second cushion layer 52 are preferably laminates which include foam materials 70 and 71 to provide cushioning and to create the stresses which result in the formation of the cavity 42. The first cushion layer 50 and the second cushion layer 52 preferably additionally include a membrane 72 which helps control the rate at which air flows into and out of the cavity 42. It is preferred that the foam materials 70 and 71 are open cell foams to allow air to pass therethrough.

The foam materials 70 and 71 can be the same or different. Preferably, the foam materials 70 and 71 are provided with different thicknesses and different densities. The thickness and density of the foam materials 70 and 71 should be sufficient to provide the desired amount of cushioning, but should not result in an unstable structure. That is, if the thickness of the foam materials are too great, it is likely that the insole will be unstable which means that the wearer experiences an undesired amount of movement under foot. Furthermore, if the foam materials are too thin, then the benefit of the foam is lost. That is, there is not enough cell structure to provide the desired degree of cushioning. Preferably, the thickness of the foam material 70 is between about ⅛ inch and about ¾ inch, and more preferably within a range of about ⅜ inch and about ⅝ inch. The thickness of the foam material 71 is preferably between about ⅛ inch and about ¾ , and more preferably between about ⅜ and about ⅝ . While the thicknesses of the foam materials 70 and 71 can be the same, it is preferable that they are different. In general, it is preferable for the foam material 70 to have a greater thickness than the foam material 71 because it is the foam material 70 which provides the softer feel by the wearer.

The densities of the foam materials 70 and 71 can be the same but are preferably different. In general, the foam material 70 is generally responsible for providing the softness experienced by the wearer's foot. In general, in order to provide the desired level of softness, it is desirable to provide the foam with a density of between about 1 lb/cf and about 1.75 lb/cf. The foam material 71 preferably has a density of between about 2 lb/cf and about 4 lb/cf. If the density of the foam material 71 is less than 2 lb/cf, it begins to resemble the foam material 70. If the density of the foam material 71 is greater than 4 lb/cf, it is generally too hard.

In a preferred embodiment, the foam material 70 is a polyurethane foam having a thickness of about ½ and a density of about 1.55 lb/cf. The foam material 71 is preferably a polyurethane foam having a thickness of ¼ and a density of about 2.40 lb/cf. The higher density foam is preferably provided approximate the outsole to provide greater impact absorption. The less dense foam is preferably provided approximate the liner to provide desired softness and cushioning as felt by the wearer.

The membrane 72 is preferably provided to control the rate at which air can enter and escape from the cavity 42. The membrane 72 is preferably provided as a relatively non-stretch material in order to help contain and control the movement of the insole 18. If the membrane is too stretchy, then the wearer may experience too much lateral movement of the foam materials 70 and 71. In general, it is preferable for the membrane 72 to be a woven or spun material. A preferred membrane can be obtained under the name Pellon from Haskel. Preferably, the membrane is bonded or laminated to the foam material. It should be appreciated, however, that the membrane need not be bonded to foam material. Furthermore, the membrane can be omitted by providing the insole with a desired degree of containment and control of air movement therethrough.

As the insole 18 is compressed, air slowly escapes from the cavity 42. As pressure is removed from the sole, the tension within the foam materials 70 and 71 cause the cavity 42 to expand as air flows therein. Accordingly, as one walks, the pressure created by the wearer's weight on the insole causes air to flow in and out from the cavity 42.

The insole of the present invention can be used in any slipper construction where a soft, cushion-like feel is desired. The shape and size of the pillow cushion can be modified to fit the insole receiving area of a particular slipper. Slipper constructions in which the insole of the present invention may be used include those described in U.S. Pat. No. 3,015,171 to Kaplan; U.S. Pat. No. 4,899,412 to Ganon, U.S. Pat. No. 5,012,541 to Ganon, U.S. Pat. No. 5,033,144 to Ganon, and U.S. Pat. No. 5,392,532 to Bray, Jr. et al. These patents are incorporated herein by reference for their disclosure of slipper constructions and manufacturing methods.

Figure 5:
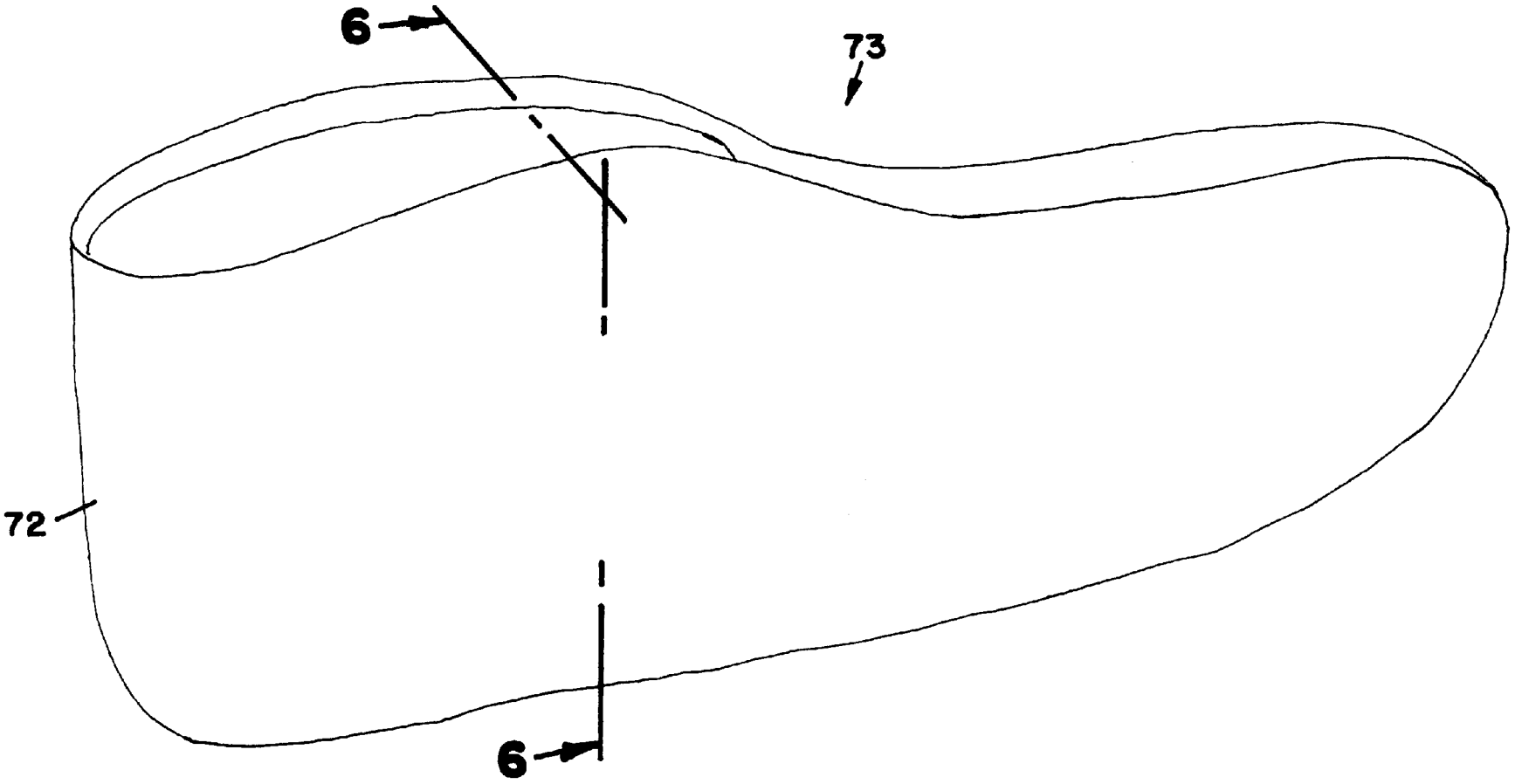
FIG. 5 is a perspective view of a boot according to the principles of the present invention.

Now referring to FIGS. 5 and 6, an alternative embodiment of the invention is described with reference to boot 73. While this alternative embodiment of the invention is characterized as a boot, it should be appreciated that it is a type of slipper. That is, it is a relatively soft construction and is washable in a conventional clothes washing machine. The characterization as a boot is a result of the extension of the upper seam 75 from the outsole 74 and up around the wearer's ankle.

The boot 73 includes an embodiment of the invention where the insole 76 attaches to the liner 78. The liner 78 includes a lining fabric 80 which has a surface 82 for contacting the wearer's foot. Preferably, a foam layer 84 is laminated to the liner material 80 to provide a laminate structure 86. The liner 78 is attached to the insole 76 along the insole perimeter 88. Preferably, the liner 78 is attached to the insole 76 by stitching at the seam 90.

A sock 92 is preferably provided covering the insole 76. Preferably, the sock 92 is provided as the same material as the liner fabric 84. Furthermore, the sock 92 can be laminated to the foam material 96.

The insole 76 includes foam materials 96 and 98. It should be appreciated that the foam material 96 is preferably a softer foam than the foam material 98. Furthermore, the foam material 98 is preferably a relatively denser foam than the foam material 96. That is, the foam material 96 is provided as a soft foam against the wearer's foot, and the foam material 98 is provided as a denser foam for absorbing the impacts created by the floor. While the sock 92 can be provided in place of an exterior membrane along the top of the insole 76, the insole preferably includes a membrane 100 along the bottom of the insole 76. Furthermore, because the foam materials can be purchased as laminates of foam and membrane, a membrane 102 can be provided on the interior side of the foam material 96.

Similar to the discussion provided above, the foam material 96 and the foam material 98 are attached along the seam 104 to provide a cavity 106 which expands and contracts as a wearer compresses and takes weight off the insole 76.

Figure 6:
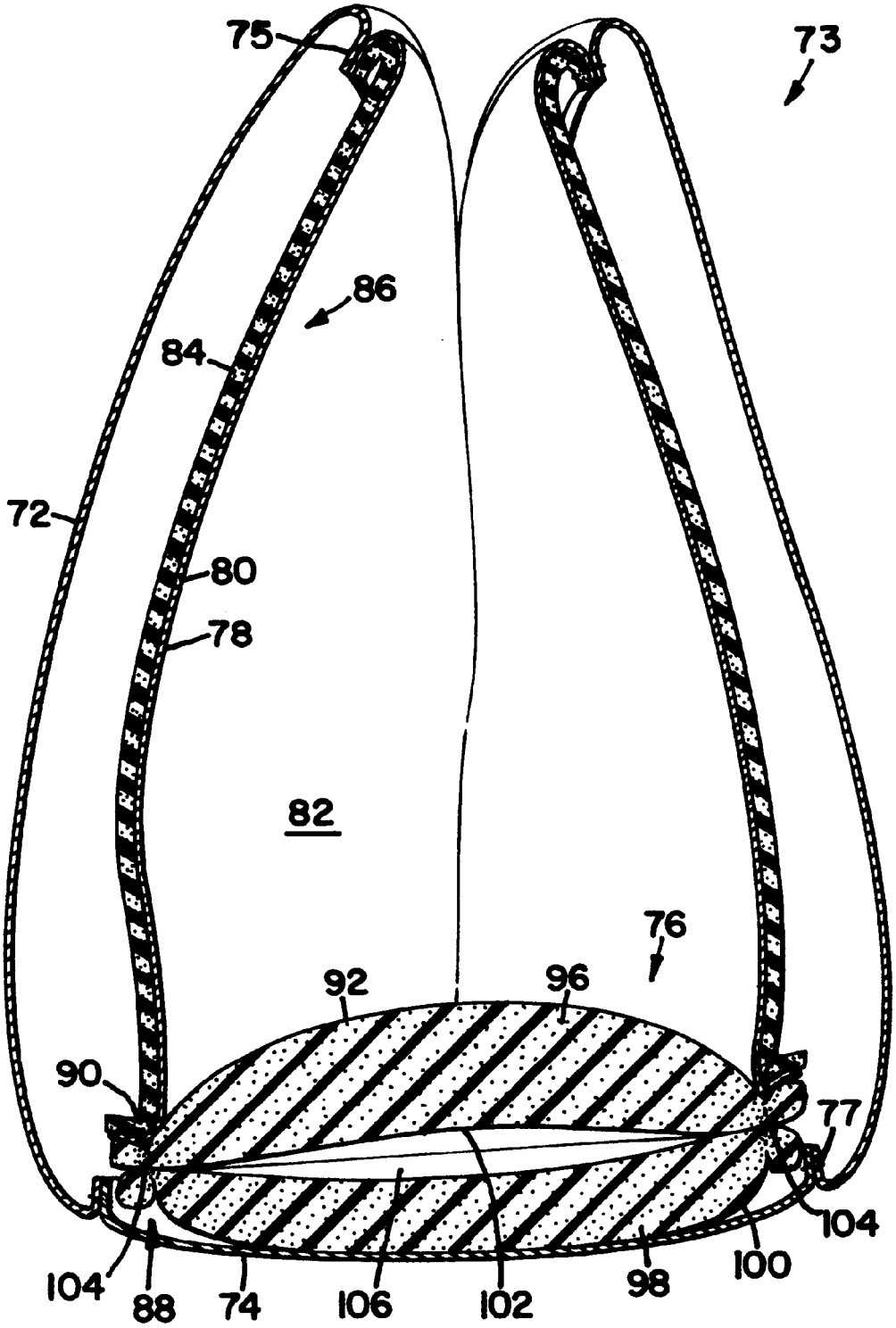
FIG. 6 is a sectional view of the boot shown in FIG. 5 taken along lines 6—6.

As shown in FIG. 6, the outsole 74 is preferably attached to the upper 72 along the outsole perimeter 77. The attachment is preferably accomplished by sewing. In addition, the upper 72 is preferably attached to the liner 78 along the upper seam 75. This attachment is similarly preferably accomplished by sewing.

Examples of manufacturing slippers having the insole of the present invention are briefly described. The steps for preparing the slipper 10 of FIG. 1 or the slipper 73 of FIG. 6 are essentially the same, although there are certain differences. In general, the components are cut from a pattern, the insole is assembled to provide the pillowy appearance, and the components of the slipper are assembled. In the case of the formation of the slipper 10, the insole 18 is inserted within the insole receiving area 30. In the case of the assembly of the slipper 73, the insole 76 is attached to the liner 78.

The foregoing description, which has been disclosed by way of the above examples and discussion, addresses embodiments of the present invention encompassing the principles of the present invention. The embodiments may be changed, modified and/or implemented using various types of arrangements. Those skilled in the art will readily recognize various modifications and changes which may be made to the present invention without strictly following the exemplary embodiments and applications illustrated and described herein, and without departing from the spirit and scope of the present invention which is set forth in the following claims.

We claim:

1. An insole for use in a slipper comprising:

a first cushion layer comprising a first foam layer and an air permeable membrane covering the first foam layer;

a second cushion layer comprising a second foam layer and an air permeable membrane covering the second foam layer;

wherein the first cushion layer and the second cushion layer are arranged so that the air permeable membrane of each layer faces outward, and the first cushion layer and the second cushion layer are attached together by stitching along their perimeter to provide a cavity between the first cushion layer and the second cushion layer, said cavity comprises a volume of between about 10% and about 40% of the volume of the insole when provided in a relaxed state.

2. An insole according to claim 1, wherein the membrane comprises a woven material.

3. An insole according to claim 1, wherein the first foam layer and the second foam layer have different densities.

4. An insole according to claim 1, wherein the first foam layer and the second foam layer have densities of between about 1 lb/cf and about 4 lb/cf.

5. An insole according to claim 1, wherein the first foam layer and the second foam layer have different thicknesses.

6. An insole according to claim 1, wherein the first foam layer and the second foam layer have thicknesses of between about ⅛ inch and about ¾.

7. A slipper comprising:

(a) an outsole having an outsole edge;

(b) a vamp attached to said outsole along at least a portion of the outsole edge to provide a foot receiving area;

(c) a liner attached to said outsole along at least a portion of the outsole edge to provide an insole receiving area; and (d) an insole provided within the insole receiving area, said insole comprising:

a first cushion layer comprising a first foam layer and an air permeable membrane covering the first foam layer;

a second cushion layer comprising a second foam layer and an air permeable membrane covering the second foam layer;

wherein the first cushion layer and the second cushion layer are arranged so that the air permeable membrane of each layer faces outward, and the first cushion layer and the second cushion layer are attached together by stitching along their perimeter to provide a cavity between the first cushion layer and the second cushion layer, said cavity comprises a volume of between about 10% and about 40% of the volume of the insole when provided in a relaxed state.

8. A slipper according to claim 7 wherein the membrane comprises a woven material.

9. A slipper according to claim 7, wherein the first foam layer and the second foam layer have different densities.

10. A slipper according to claim 7, wherein the first foam layer and the second foam layer have densities of between about 1 lb/cf and about 4 lb/cf.

11. A slipper according to claim 7, wherein the first foam layer and the second foam layer have different thicknesses.

12. A slipper according to claim 7, wherein the first foam layer and the second foam layer have thicknesses of between about ⅛ inch and about ¾.

13. A slipper comprising:

(a) an outsole having an outsole edge;

(b) an upper attached to said outsole along at least a portion of the outsole edge;

(c) an insole comprising:

a first cushion layer comprising a first foam layer;

a second cushion layer comprising a foam layer;

wherein the first cushion layer and the second cushion layer are attached together along their perimeter to provide a cavity between the first cushion layer and the second cushion layer, said cavity comprises a volume of between about 10% and about 40% of the volume of the insole when provided in a relaxed state; and (d) a liner attached to the outsole and to the perimeter of the insole.

14. A slipper according to claim 13, wherein the first cushion layer and the second cushion layer have densities of between about 1 lb/cf and about 4 lb/cf.

15. A slipper according to claim 13, wherein the first cushion layer and the second cushion layer have thicknesses of between about ⅛ inch and about ¾.

16. A method for manufacturing a slipper, the method comprising steps of:

(a) providing a first cushion layer and a second cushion layer, said first cushion layer comprising a foam layer and an air permeable membrane covering the foam layer, said second cushion layer comprising a foam layer and an air permeable membrane covering the foam layer;

(b) arranging the first cushion layer adjacent to the second cushion layer;

(c) fastening the first cushion layer to the second cushion layer by stitching along their perimeter to provide a cavity therebetween, said cavity comprises a volume of between about 10% and about 40% of the volume of fastened first cushion layer and second cushion layer when provided in a relaxed state; and (d) inserting the fastened first cushion layer and second cushion layer inside an insole area of a slipper.

* * * * *